United States Patent [19]

Burgess et al.

[11] Patent Number: 4,653,826

[45] Date of Patent: Mar. 31, 1987

[54] HIGH CURRENT CONNECTOR

[75] Inventors: Christopher N. Burgess, Poughkeepsie, N.Y.; Ned E. Corman, Harrisburg, Pa.; Lee A. Barkus, Millersburg, Pa.; Steven J. Kandybowski, Tower City, Pa.; Matthew M. Sucheski, Harrisburg, Pa.

[73] Assignee: AMP Incorporated, Harrisburg, Pa.

[21] Appl. No.: 833,320

[22] Filed: Feb. 24, 1986

[51] Int. Cl.[4] ..... H01R 13/193

[52] U.S. Cl. ..... 339/64 M; 339/255 R; 339/262 R

[58] Field of Search ..... 339/64 R, 64 M, 255 R, 339/259, 262

[56] References Cited

U.S. PATENT DOCUMENTS 3,064,266 11/1962 Cole ..... 339/64 M 3,566,334 2/1971 Ziegler, Jr. ..... 339/64 M

*Primary Examiner*—Joseph H. McGlynn

*Attorney, Agent, or Firm*—Eric J. Groen

[57] ABSTRACT

A high current power connector has contact elements defining a pin receiving opening. The contact elements are spring loaded inwardly to increase the contact force between each contact element and a pin. The connector also has the capability for the contact members to float and to realign themselves if the pin and contact elements are misaligned.

24 Claims, 26 Drawing Figures

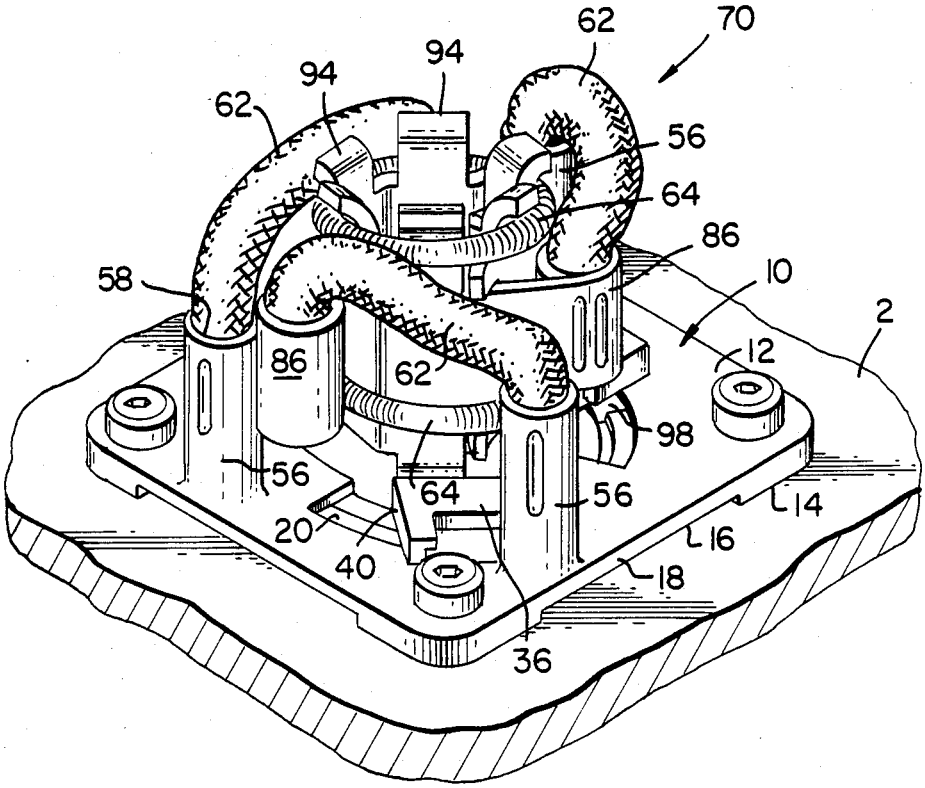
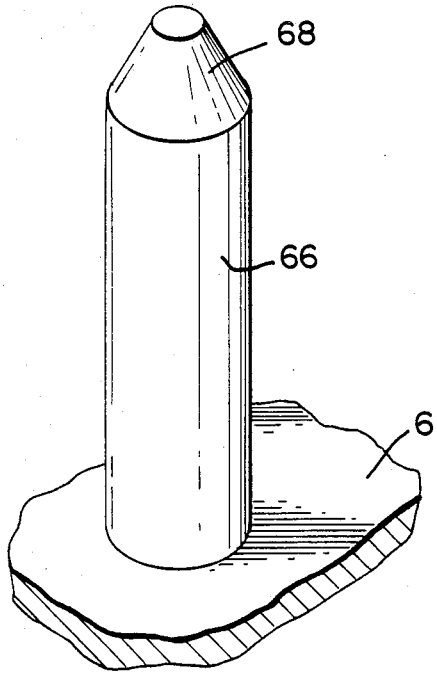
Fig. 1

FIG. 3
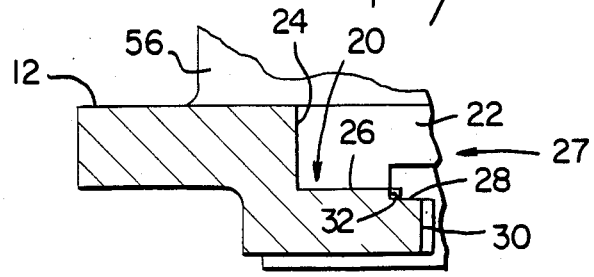
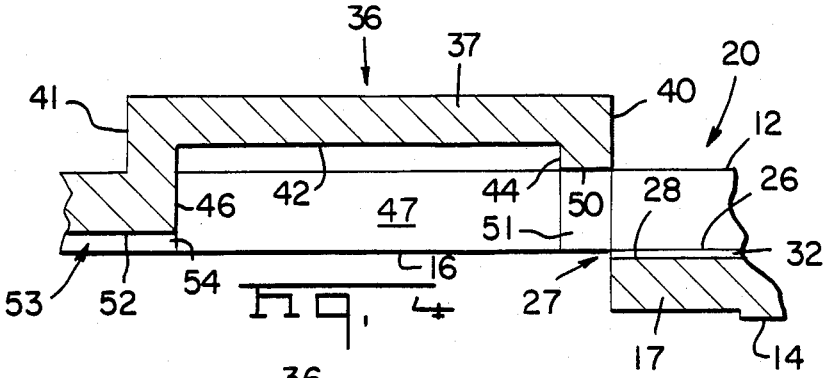
FIG. 4
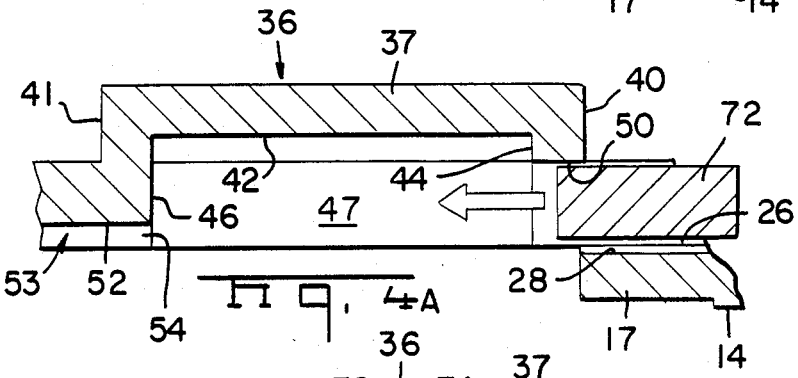
FIG. 4A
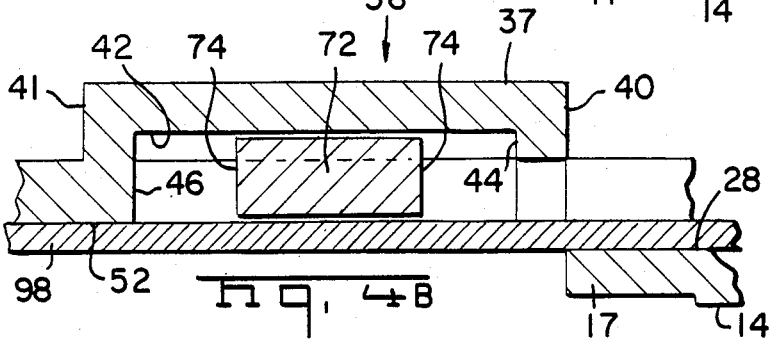
FIG. 4B 102
114
110
198
164
171
164
160
194
166
112
186
186
178
116
185
173
195
166
176
199
110
162
160

HIGH CURRENT CONNECTOR

BACKGROUND OF THE INVENTION

1. Field of the Invention

The present invention relates to an electrical connector and more particularly to a high current pin and contact connector, the connector having the ability to float to engage the pin and socket when misaligned.

2. Prior Art

There are many instances where a module is connected to a planar bus, and it is required to disconnect the module from the bus for reasons such as maintenance. The present method of connecting the module to the power bus is to hard wire the bus and module together by such means as a cable on the module having a spade or ring connector mounted to its end, for fitting over a threaded portion extending from the bus. The present method requires difficult and timely maintenance for removal of the module.

It is highly desirable then, to provide a pin and contact high current connector for interconnecting the bus and module. It would also be highly desirable to provide for radial misalignment of the pin and connector. For example, the module may be mounted in a slidable arrangement with the bus. If the pin and contact are misaligned the module would have to be withdrawn and the pin or contact realigned. If the pin and contact could allow for some axial misalignment, the design would be advantageous for initial installation and during maintenance of the module.

Some existing designs presently available provide for misalignment of the pin and connector, but not in the radial direction. For example U.S. Pat. No. 3,094,364 relates to a low current connector having a misalignment feature, but the misalignment is in the tipped mating of connector half 4 with contact pins 20, as shown in FIGS. 3–5 of the U.S. Pat. No. 3,094,364 patent.

It is also highly desirable to design a connector having a relatively few number of components, alleviating unnecessary labor costs during assembly and/or disassembly. One connector, disclosed in U.S. Pat. No. 3,982,806, requires several components to achieve its contacting feature, necessitating high assembly costs and resultant high selling cost.

The connector in U.S. Pat. No. 3,982,806 comprises a fixture 60 having guiding and supporting recesses 64, axially aligned and axially arranged, on the inside diameter thereof. Each recess contains a leaf spring member 68 and a contact finger 75. To contain the contact fingers 75 within their respective recesses 64, while the pin member 35 is withdrawn, a cylindrical retainer 86 must be installed within the cavity of the fixture 60. Given the complexity of the contact assembly in the U.S. Pat. No. 3,982,806 patent, it can be appreciated than that a connector having few components and that is easily assembled, is highly desirable.

SUMMARY OF THE INVENTION

The present invention relates to a high current connector having interlocked contact members which are inwardly biased towards a center, and form an opening to receive a pin. The contact members are attached to a base and are commoned to the base by means of a flexible cable. When the base is mounted to a bus and the pin is inserted, they provide electrical continuity between the bus and the module.

It is one object of the present invention to design a high current connector having a pin and contact assembly for handling current in the range of 100–400 amps.

It is a further object to design a high current connector with blind mate pluggability. That is, the pin and contact assembly should have the capability of adjusting for some radial misalignment during axial insertion of the pin into the contact assembly.

It is a further objective to design a high current connector having parallel resistance paths to minimize the effects of constriction resistance. That is, it is an object to provide the connector with parallel and redundant lines of contact between a pin and between the contact surfaces.

It is a further objective to design a high current connector having individual contact elements forming a pin-receiving area. The contact elements should be spring loaded inwardly towards the axial centerline of the pin receiving area, to preload the contact members.

It is a further objective to have a high current connector having an anti-overstress feature such that, upon attempting insertion of a misaligned pin, the deflection of the contact members is stopped before the biasing feature of the connector is taken past its elastic limit.

It is a further object to design a high current connector having low electrical resistance and high conductivity to maintain an efficient electrical connection and to minimize temperature rise.

It is a further object to design a high current connector having a low pin to contact assembly insertion force. As the connection system will be utilized in areas where manual insertion of the pin into the contact is necessary, the insertion force must be kept within ergonomically desirable limits.

Three embodiments of the subject invention are disclosed herein, which meet the aforementioned design objectives. Each connector system is suitable for high current applications, designed for low electrical resistance, has two parallel lines of contact between the contacts and a pin, has an anti-overstress feature, has preloaded contacts, has the capability for blind mate pluggability, and is designed for a low insertion force.

The high current capabilities are directly related to the material composition of the pin and contact, and to the contact force between the contact members and the pin. The contacts and pin utilize a copper-based alloy and are further plated with silver to establish and maintain a low interface resistance. To increase the current carrying capability of the contact assembly, the contact members are spring loaded inwardly towards the center of the pin. The spring loading of the contact members also preloads the contact members which further minimizes the necessary expansion of the contact elements to meet the desired amount of contact force. The insertion force of the pin increases as the contact force between the contact members and the pin increases, thus there is a tradeoff between the current carrying capability and the insertion force, and an optimum matching must be reached.

The first embodiment of the invention comprises three interlocking contact members spring-loaded inwardly to form a pin-receiving area. Each contact member has two planar surfaces parallel to an insertion axis of the pin-receiving area which forms a pin-receiving area having a hexagonal cross section. The assembled contact members are associated with a base, each contact member having a foot which is receivable in a groove in the base, providing a flotation feature of the contact assembly relative to the base. Each contact member further provides for a wire braid connecting the contact member to the base.

The second embodiment of the invention has a generally U-shaped contact member having two planar surfaces which are parallel to an insertion axis of a pin. The contact member is interconnected to a base member which allows for flotation of the contact member relative to the base member. Wire braids are connected to the contact member and to a bus member, commoning the contact member with the bus.

The third embodiment of the invention comprises two contact members having a right-angled cross section. The contact members interlock to form a generally square cross section. One of the contact members is mounted to a bus member while the other contact member is allowed to float relative to the first contact member. Wire braids contact the second contact member with a bus member providing electrical continuity between the second contact member and the bus.

Three examples of the subject invention are disclosed by way of the following Figures.

BRIEF DESCRIPTION OF THE DRAWINGS

FIG. 1 is a perspective view of the complete connector assembly of the first embodiment.

FIG. 3 is a cross-sectional view through lines 3—3 of FIG. 2.

FIG. 4A is the view of FIG. 4 showing the contact foot entering under the locking tab.

FIG. 4B is the cross-sectional view of FIG. 4 showing the contact foot locked in place by the snap-ring.

FIG. 5A is a perspective view of the three contact members exploded away from one another.

FIG. 9 shows the complete assembly of the second embodiment.

FIG. 13 is a side view of the second embodiment showing the pin inserted.

DETAILED DESCRIPTION OF THE PREFERRED EMBODIMENTS

Figures 14, 14A:
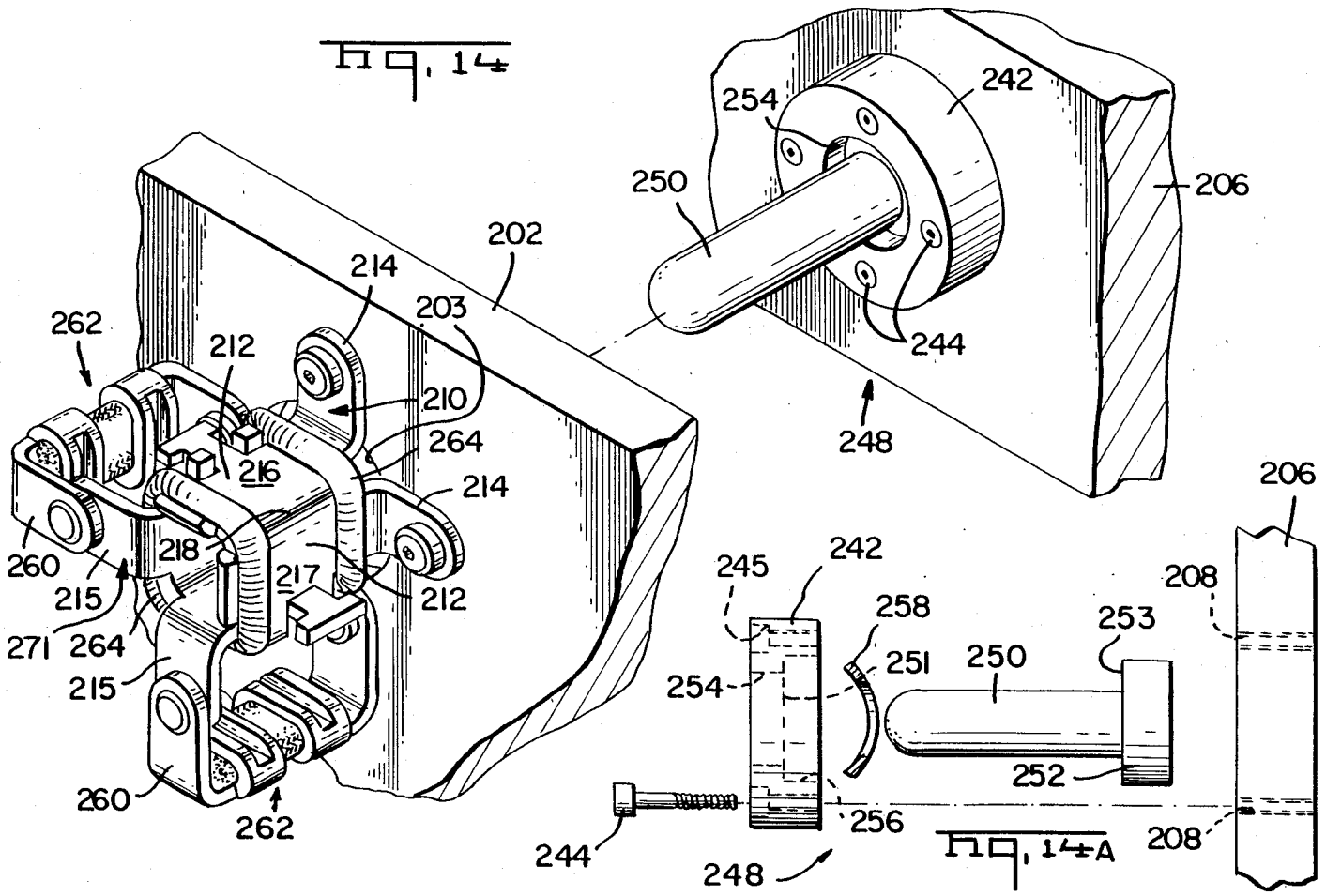
FIG. 14 is a perspective view of a third embodiment.
FIG. 14A is an exploded side view of the pin assembly.

Three embodiments of the subject invention are disclosed herein, shown generally in FIGS. 1, 9 and 14 which meet the aforementioned design objectives. That is, each connector system is suitable for high current applications, each is designed for low electrical resistance, each has at least two parallel lines of contact between the contact elements and a pin, each has an anti-overstress feature, each has preloaded contacts, each has the capability for blind mate pluggability, and each is designed for a low insertion force. Furthermore, these seven design objectives are interrelated from a structural standpoint.

To achieve a high current rating on the connector system, each design embodiment utilizes a copper based alloy for the pin and contacts having good conductive qualities. The pin and contact members are further plated with silver to establish and maintain a low interface resistance.

The high current capabilities are also directly related to the contact force between the contact members and the pin. As the contact force between the contacting members increases, the current carrying capabilities through the contact members also increases. A contact force between the contact members and the pin is achieved by spring loading the contact members inwardly towards the center of the pin. Thus, increasing the spring constant of the spring results in increasing the contact force between the contact and pin.

The preload on the contact elements is achieved in a common mode in all of the three embodiments. Each embodiment comprises a tension spring wrapped around the contact elements forcing the contact elements radially inward towards an axial pin-receiving centerline. The preload provides that the contact elements can be further deflected, radially outward by the insertion of the pin, to the desired amount of contact force, without having to deflect the contacts outwardly substantially. Employment of a preload to the contact elements further increases the pin to contact misalignment capability.

However, the insertion force of the pin into the contact receiving area is also directly related to the contact force between the contacting members, such that the insertion force increases as the contact force between the pin and the contacts increase. It can be appreciated that as the contact force between the contact members and the pin increases, that the insertion force will too increase, as each contact member must be biased inwardly against the pin. Ultimately then, there is a tradeoff between the current carrying capability and the insertion force, and an optimum matching must be reached.

The subject invention relates to the optimum design points for a high current connector. It has been found that the preferred embodiment of each design of connector will utilize a pin and contact of a material of substantially copper or copper alloy, and then further plated with silver. The optimum design contact force between the contacting members and the pin is between 10–14 pounds of force, which results in an insertion force of approximately 15–21 pounds of force. This contacting force will allow a current rating of 400 amps with a temperature rise of only 20° C. The material composition and the contacting force between the contact members and the pin are the same for all three embodiments of the invention. However, each embodiment differs in design geometry relating to its capability for blind mate pluggability; for allowing two lines of contact between the pin and contact elements; and for preventing the overstress of the springs; thus the design geometry for each embodiment will be individually described in detail as follows.

Figure 2:
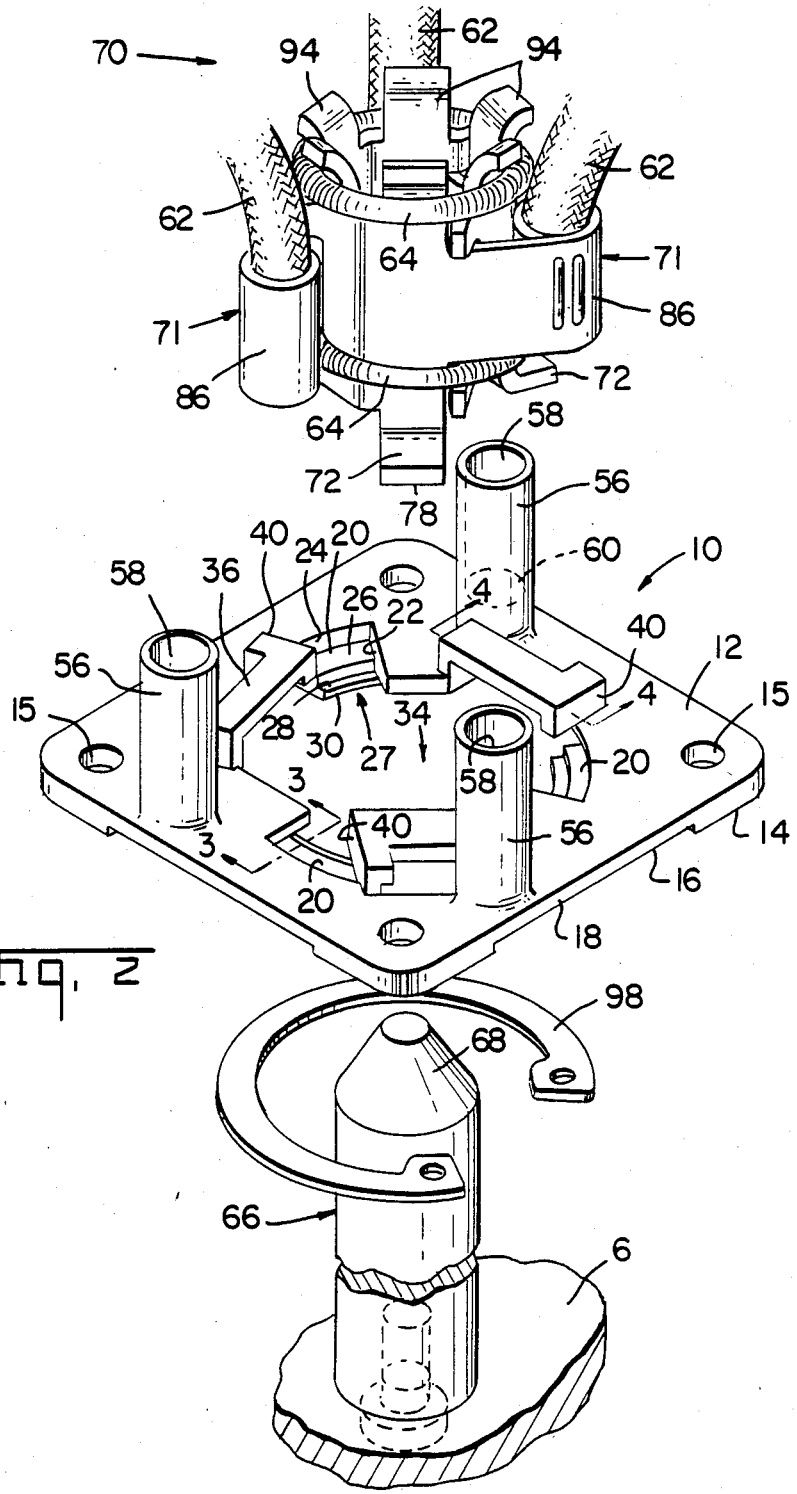
FIG. 2 is similar to FIG. 1 showing the components exploded away from the connector.
Figure 7A:
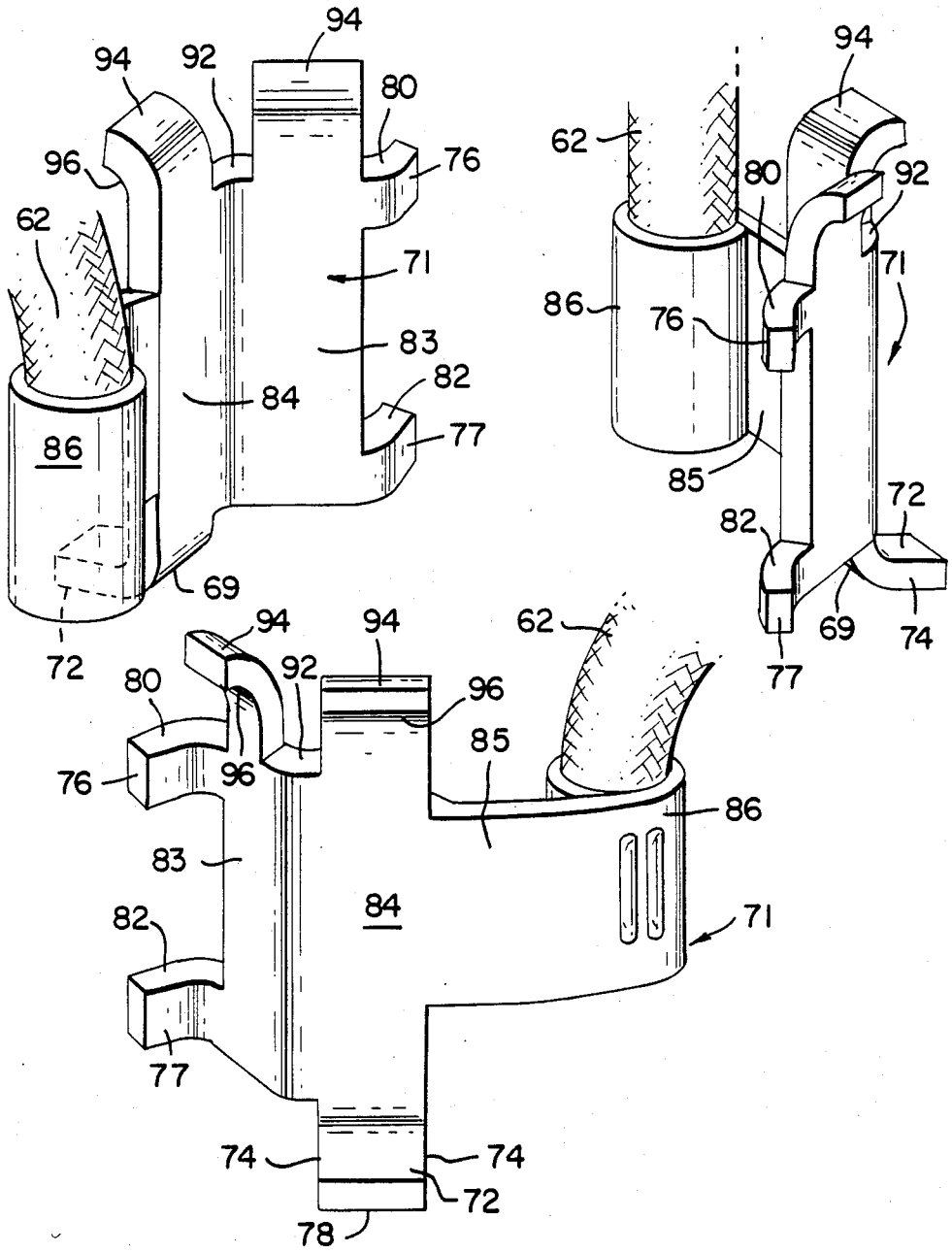
FIG. 7 is a top view of the three contact members with the retaining springs wrapped around them.

Referring to FIGS. 1 and 2, the complete assembly of the first embodiment is exploded showing the base member 10, the contact assembly 70 and pin 66. The base member 10 is constructed of a material having good conductive qualities, such as copper. The base 10 comprises a top surface 12, a bottom surface 16 and side edges 18. The base 10 also includes mounting holes 15 and raised feet 14, feet 14 located only at the locations of the mounting holes 15. Base member 10 also includes a pin entry hole 34 for receiving the pin through the base member 10 from the mounting side.

Figure 4:
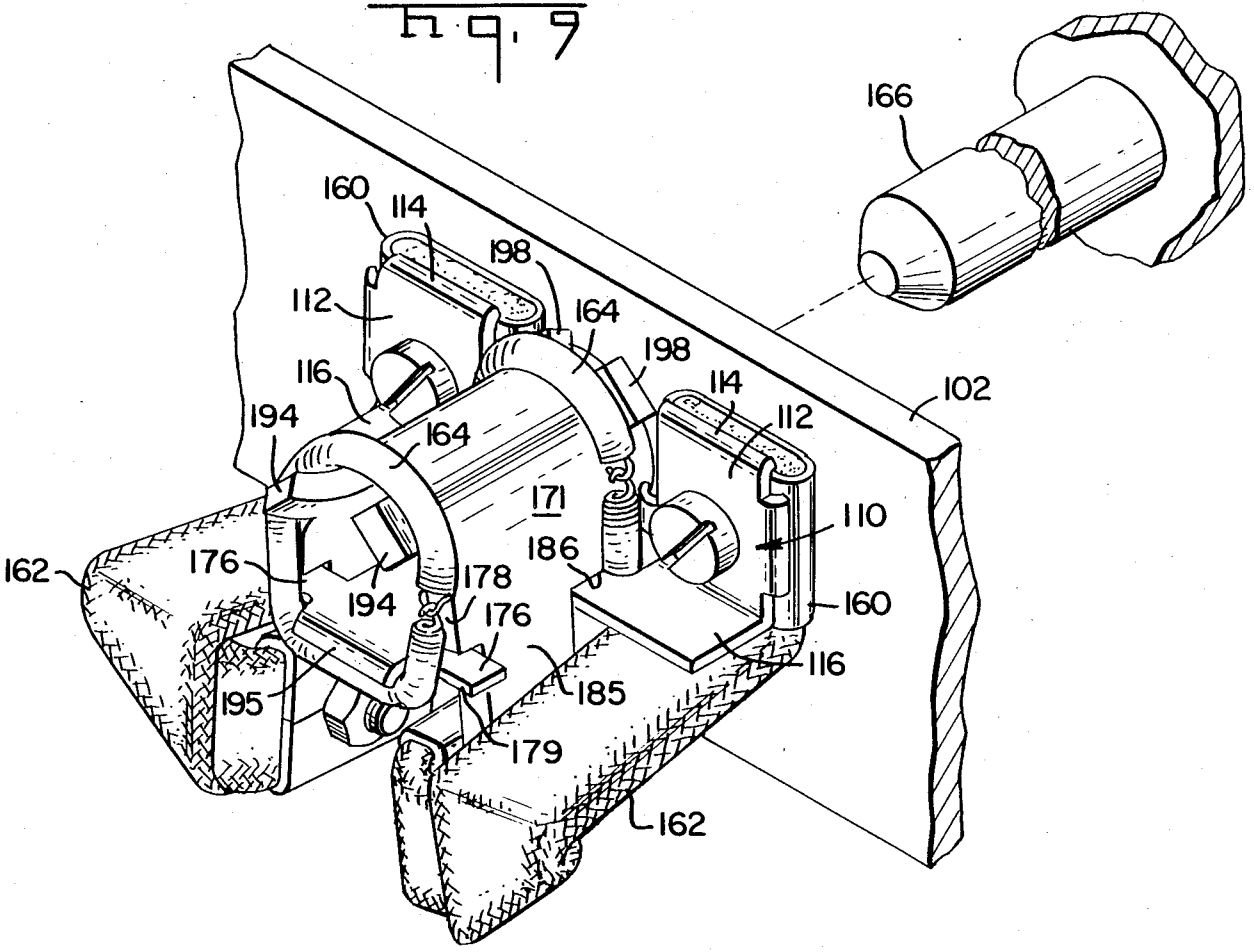
FIG. 4 is a diagrammatical view of section 4—4 of FIG. 2.

As best seen in FIGS. 3 and 4, base 10 further includes three feet receiving slots 20, the slot defined by end surface 24, side surface 22, floor 26 and locking tab side wall 40. Section 17 is raised away from surface 16 but is not raised to the extent of foot 14, as best shown in FIG. 4. Raised section 17 provides material to bottom surface 16 allowing bearing surface 32 and thrust surface 28 to be cut therein.

Surfaces 28 and 30 provide for a snap-ring shoulder 27 for receiving and retaining a snap-ring 98. Shoulder 27 has as an inner radius of curvature surface 30 and has a recessed bearing surface 32 which is concentric with inner radius 30. Between surface 30 and 32 is a bearing thrust 28.

Base 10 further includes a locking tab 36 adjacent to the feet receiving slot 20. As best shown in FIG. 4, tab 36 includes sidewalls 40 and 41 upstanding from surface 12 and enclosed by top wall 37. The interior of tab 36 is bounded by surfaces 42, 44 and 46, which define a feet receiving groove 47. The wall 40 of the tab 36 is cut away for part of its depth leaving surface 50 of upstanding wall 40 parallel and coplanar with surface 12, and surface 51 perpendicular to surface 12 extending between surface 16 and surface 12. The cutaway in wall 40 provides for communication between feet receiving slots 20 and feet receiving groove 47, as best shown in FIG. 4.

Adjacent to surface 46, as shown in FIG. 4, is a groove 53 cut into surface 16. Groove 53 is formed by top wall 52 which is parallel to surface 16, and by surface 54 which is perpendicular to surface 16.

Referring again to FIG. 2, base member 10 includes three crimp barrels 56 having holes 58 leading to counterbored surface 60. Barrels 56 receive wire braids 62 and then can be crimped, (FIG. 1) maintaining the braids 62 within the barrel 56.

Referring again to FIG. 2, a contact assembly 70 is shown, the assembly 70 comprising three contacts 71. With reference to FIG. 5A, each contact 71 has interlocking tabs 76 and 77 extending from plate section 83, each tab having upper surfaces 80 and 82, respectively. Plate section 83 is in transition with plate section 84 through corner 92. Extending from the side of plate section 84 is arm 85 which is rolled at its end into crimp barrel 86. Extending outwardly from the lower edge of plate 84 is foot 72, having side edges 74 and bottom surface 78. Contact 71 also includes an ear 94 extending from the top surface of plates 83 and 84, the ears are curved outwardly forming radial surface 96. The assembly of the contacts 71 with the base member 10 provides for a full floating contact connector.

Figure 5C:
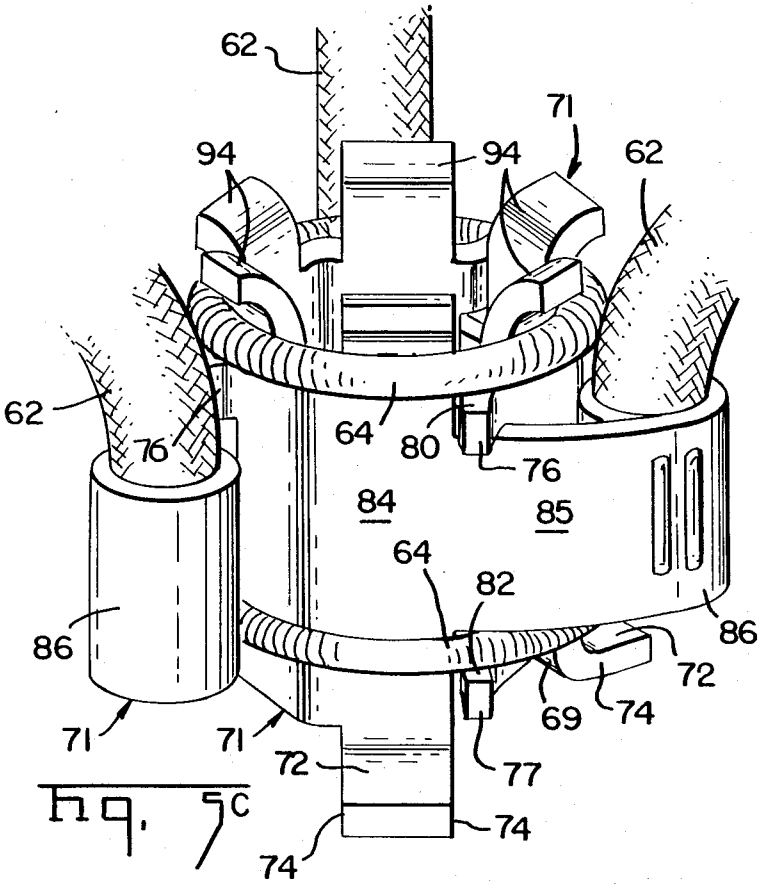
FIG. 5C is similar to that of FIG. 5B showing the three contact members locked together by the springs.
Figure 5B:
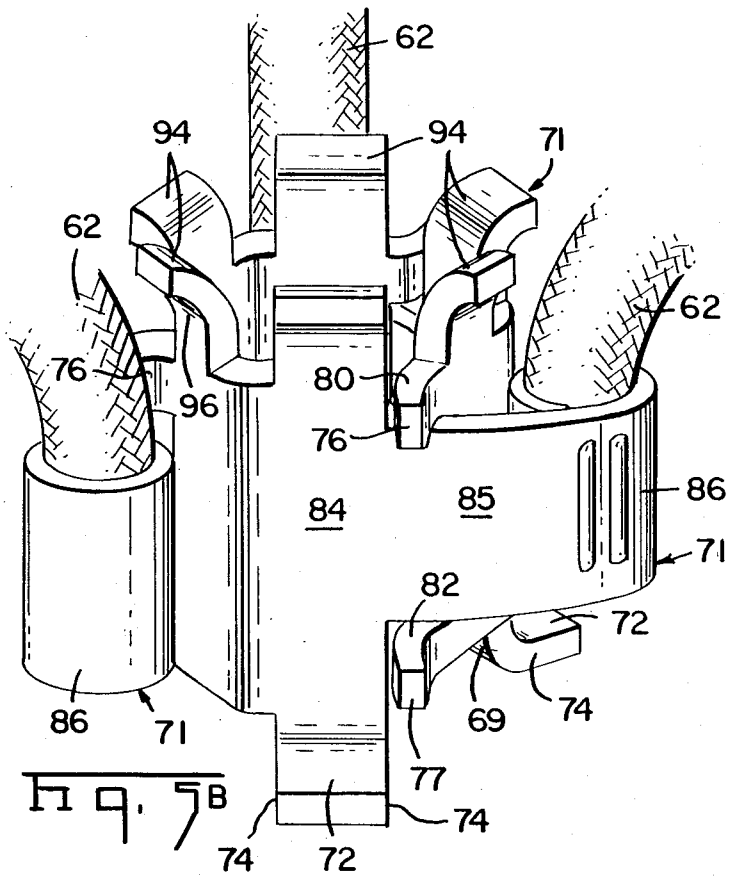
FIG. 5B is a perspective view similar to that of FIG. 5A showing the contact members interlocked with one another.
Figure 7:
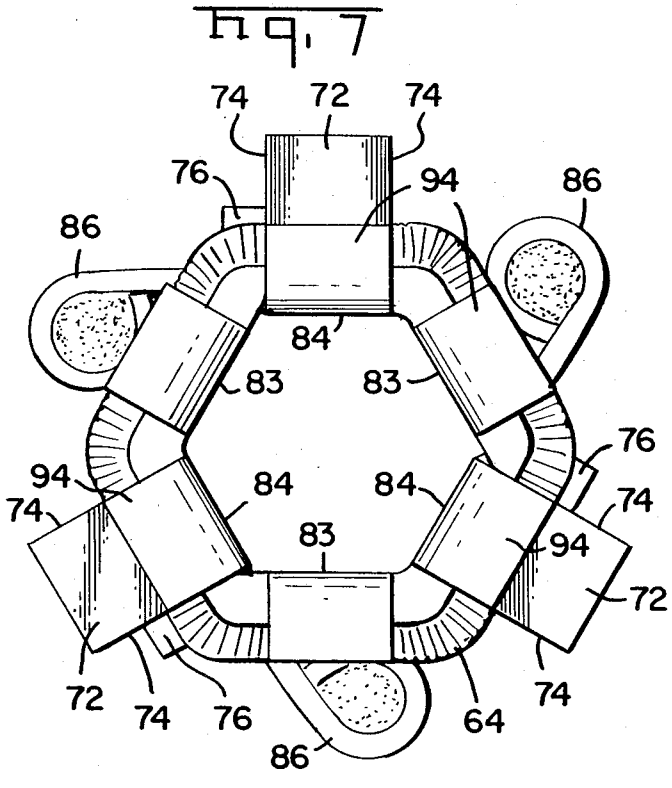

The contact assembly 70 is assembled by linking the three contacts 71 together, the tabs 76 and 77 interlocking with extension arm 85, as best shown in FIG. 5B. When all three contacts are linked together the contact members 71 have a hexagonal cross section, the plates 83 and 84 of each contact 71 facing inwardly towards a center, as shown in FIG. 7. A first spring 64 is then placed over the three contact feet 72, the spring fixed in the space between the lower edge of extension arm 85 and the upper surface 82 of tab 77, as best shown in FIGS. 5B and 5C. A next spring 64 is placed over the top of the three contacts 71, the springs 64 fixed in place between radial surfaces 96 of ears 94 and between upper surfaces 80 of tabs 76, as shown in FIGS. 5B and 5C.

As designed, the extension arms 85, the crimp barrels 86 and the plates 83 provide an anti-overstress feature, preventing the contact elements 71 from expanding to the extent of overstressing and elastically deforming the springs 64. As best shown in FIGS. 5B and 7, crimp barrels 86 are rolled from the outside in, the end of the rolled barrel being adjacent the plates 83. Thus, the contact elements 71 will only move outwardly to the point where the rolled end of the crimp barrel 86 contacts the plate 83. If the pin 66 is too large or if the pin 66 is skewed relative to the axial centerline of the pin receiving area, the contact members 71 will only open to the point where the crimp barrels 86 abut the plates 83, thereby preventing overstressing the springs 64.

After the three contacts 71 are assembled, as shown in FIG. 5C, contact assembly 70 is inserted into the base, each foot 72 is lowered into a receiving slot 20 until lower surface 78 of foot 72 bears on surface 26, as best shown in FIG. 2. The contact assembly 70 is then rotated counterclockwise, the contact foot 72 sliding under surface 50 of upstanding wall 40, and into feet receiving groove 47, as best shown in FIG. 4A. The contact assembly is then completely rotated until the foot 72 is completely under the top wall 37, as best shown in FIG 4B. The snap ring 98 is then installed from the underside and seated between grooves 53 and shoulders 27, as shown in FIGS. 4 and 4B. When the snap ring 98 expands outwardly, it bears on surface 54 of groove 53 and surface 32 of shoulder 27. The snap ring 98 is then locked in a fixed axial relationship between surfaces 52 and 28.

Once the snap ring 98 is installed, the feet 72 and thus the contact assembly 70 is precluded from movement in the axial direction, each foot being locked between a respective surface 42 of locking tab 36 and between snap ring 98, as shown in FIG. 4B. As best shown in FIG. 4A, the distance between surface 50 and surface 26, which is adequate for entry of foot 72, is partially taken up by the thickness of the snap ring 98, as best shown in FIG. 4B. Thus, the foot 72 is bounded on each side, that is, edges 74 of foot 72 may move only between surfaces 46 and 44.

To maintain adequate electrical continuity between the contact assembly 70 and the base 10, wire braids 62 are crimped between the crimp barrels 56 on base 10 and between the crimp barrels 86 on the contact assembly 70, as best shown in FIG. 1. As the contact assembly 70 and the base are both made of copper, the crimp barrels 86 and 56 are pliable enough to sufficiently crimp onto the wire braid 62. After the contact assembly is locked within the tab 36 and the wire braids 62 are crimped between barrels 56 and 86, the connector is ready for installation on a planar bus 2, and the pin 66 for installation on a module 6 needing the power from the bus 2.

Referring now to FIGS. 1 and 2, the connector base 10 can be attached to a power bus 2, the raised feet 14 planted squarely on the bus, then secured by a bolt, or the like, through the bus 2 and hole 15 in base 10. Bus 2 will have a hole therethrough, (not shown), in alignment with the pin entry 34 in base 10, such that the pin can be installed from the rearward side of the connector and through the bus 2 to contact assembly 70, as shown in FIG. 1. The pin is then connected to the module 6 which requires the power from the bus 2.

If the module moves in an axial direction, such as if the module 6 is in a drawer and slides forwardly and rearwardly to contact the bus 2, the subject connector has a full floating feature that will realign the contact assembly if the pin and contact assembly are not perfectly aligned. This feature provides for ease of assembly both at the time of manufacture and during maintenance. When the module is originally installed, the pin and contact assembly do not have to be perfectly aligned as the floating contact assembly will take up the misalignment. If, during maintenance the drawer is withdrawn and the pin and contact become misaligned, the floating contact assembly will take up that misalignment.

Figure 6A:
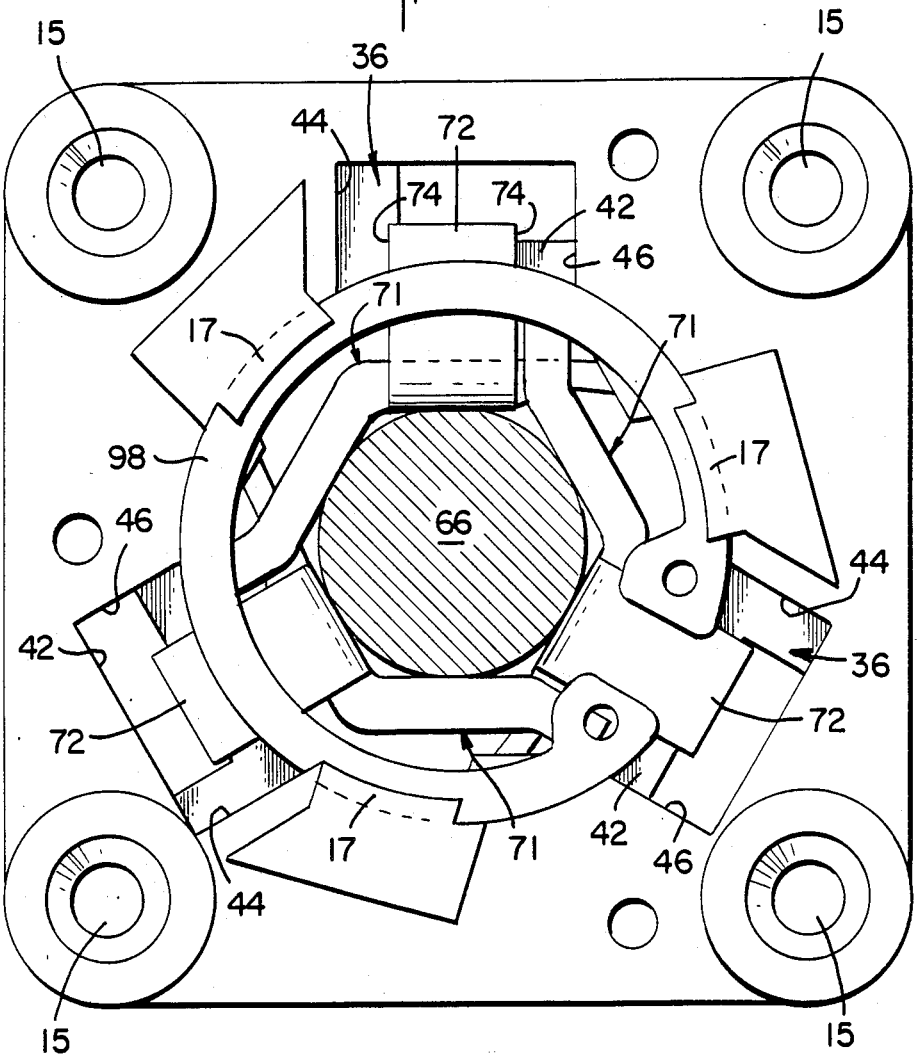
FIG. 6A is a bottom view of the base showing the three contact members centered.
Figure 6B:
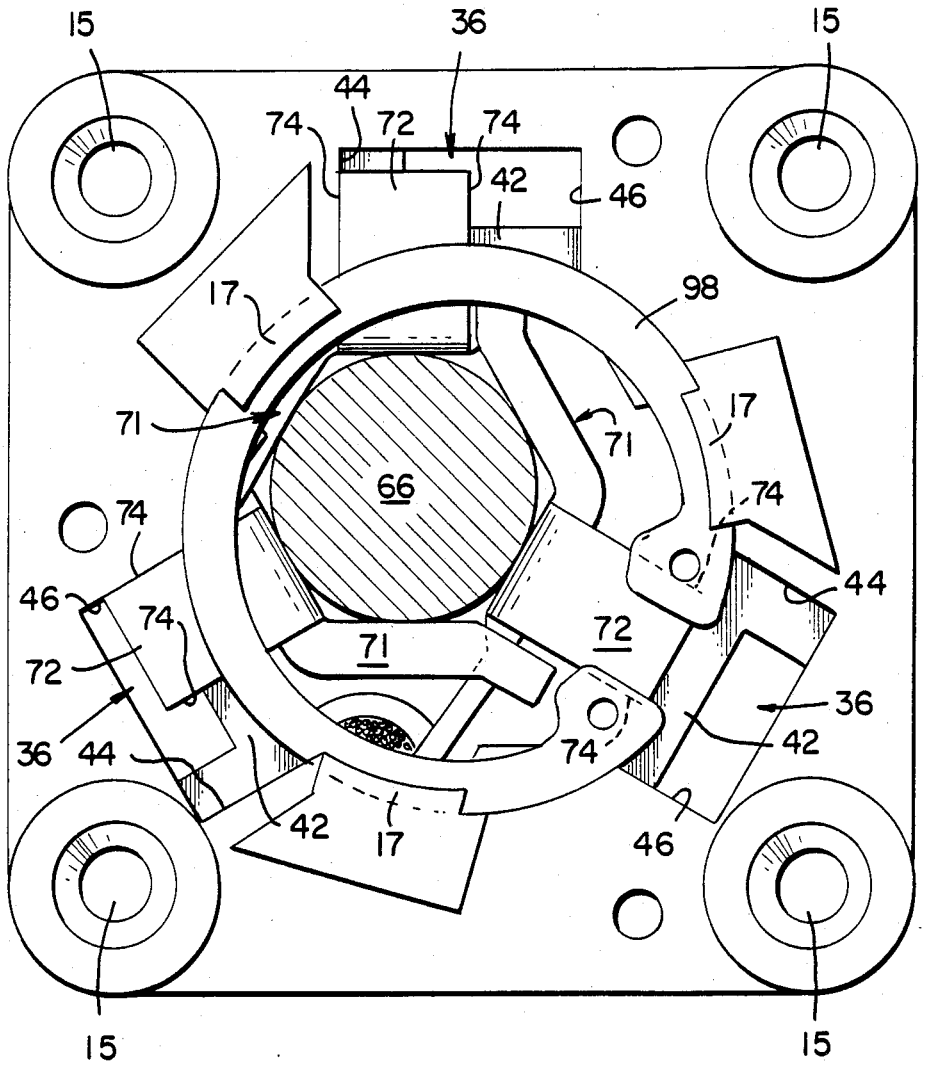
FIG. 6B is a bottom view of the base similar to FIG. 6A showing two feet bearing against their stop surfaces to show maximum misalignment.
Figure 8:
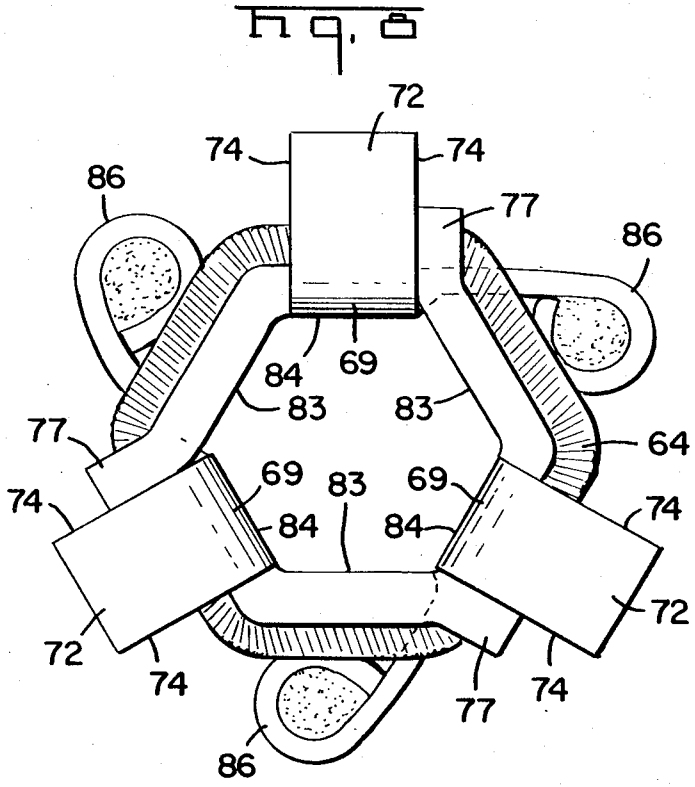
FIG. 8 is a bottom view of the three contact members with the retaining springs wrapped around them.

As previously mentioned with reference to FIG. 4B, contact leg 72 may float under the locking tab 36 between surfaces 46 and 44. If each contact foot 72 is centered within its own respective locking tab 36, the contact assembly 70 is centered radially with respect to the base 10, as shown in FIG. 6A. However, the contact assembly may float until edge 74 of one foot 72 is bearing against surface 46 and edge 74 of a second foot 72 is bearing against surface 44 within its respective locking tab 36, as shown in FIG. 6B. As the contact assembly may float within the base in all directions to the extent shown in FIG. 6B, the contact assembly is fully floating, that is, the real center may float in a circular manner in all four quadrants from its designed center.

When the pin 66 is inserted, as shown in FIG. 6A, the pin 66 is contacted at six points, each side of the formed hexagon contacting the pin 66. Each contact element 71, has contact plates 83 and 84, and each individual contact element 71, makes two lines of contact with the pin 66. By providing parallel and redundant lines of contact, the effects of constriction resistance are minimized.

To assure adequate contact force with the pin 66, the contact members 71 are spring loaded, and the hexagonal opening is smaller than the pin. That is, the distance between opposed sides of the hexagon is less than the pin diameter, requiring the pin 66 to spread the contact members outwardly, increasing the distance between opposed sides of the hexagon. By preloading each of the contact elements 71, the amount of contact movement and spring deformation is minimized, thereby increasing the amount of possible realignment between the contact assembly 70 and pin 66.

Furthermore, as the realignment of the pin-receiving area and the preload on the contact elements 71 are achieved by means of separate design features, the pin-receiving area is fully floating while maintaining consistent and uniform insertion force. That is, the pin-receiving area floats as a result of the contact feet 72 being disposed in the feet receiving grooves 47 of the base 10. Rather, the preload on the contact members 71 is achieved by resiliently biasing the contact members 71 inwardly by means of tension springs 64. As the contact assembly 70 may float with respect to the base 10, without affecting the position of the individual contact members 71 as they relate to the contact assembly 70, the contact force on the pin 66 and the insertion force of the pin 66, will always be consistent.

To facilitate the pin insertion and to minimize insertion forces, the pin 66 has a beveled end providing a lead-in section 68. Furthermore, as the feet 72 are formed outwardly, each of the contact members 71 includes an inner radius of curvature 69 on the feet, providing a transition section for pin 66. Thus, the first embodiment discloses a fully floating pin and contact connector, the connector maintaining continuity between the bus 2 through the base 10, wire braids 62, contacts 71 to the pin 66 and on to the module 6.

Figure 10:
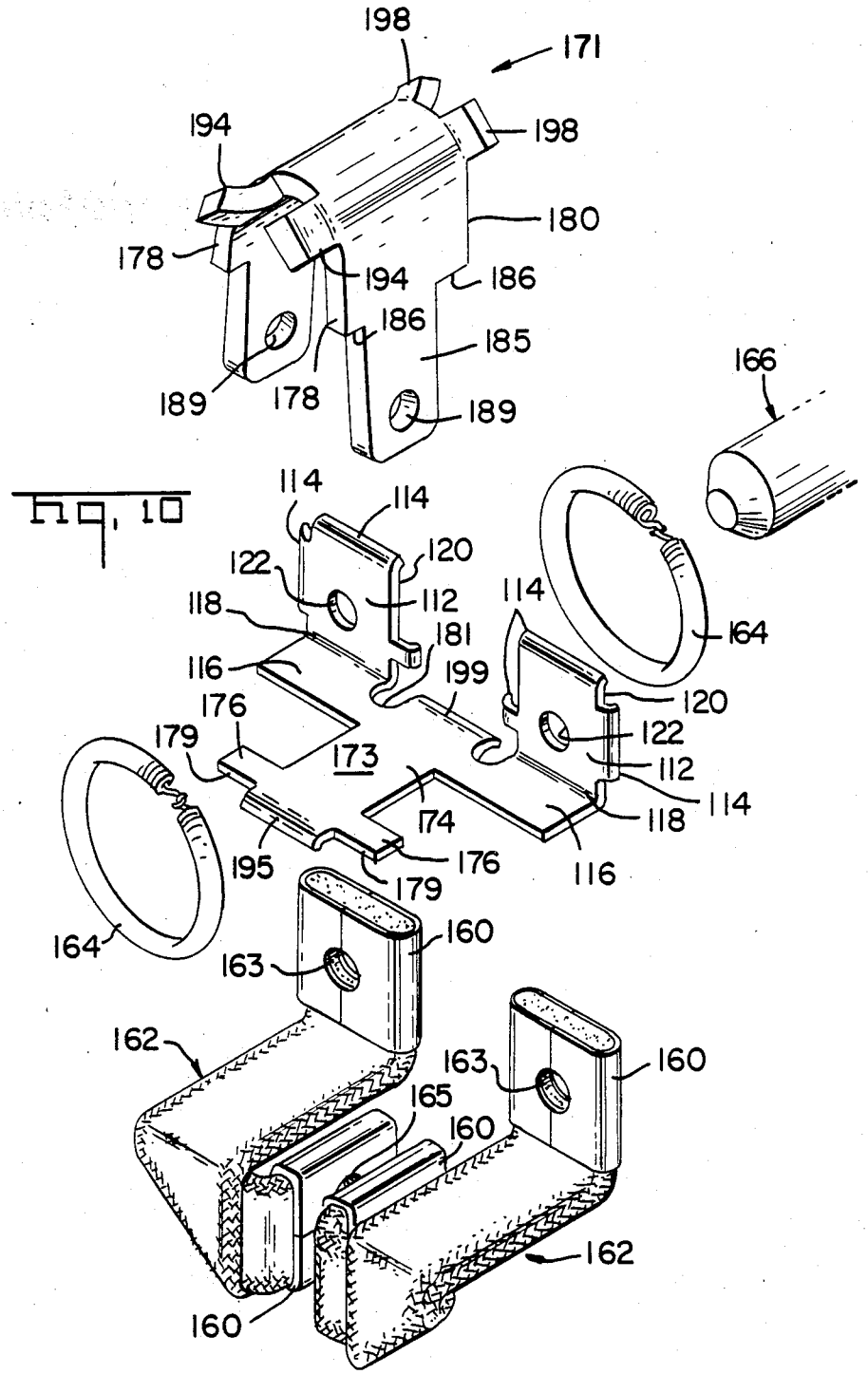
FIG. 10 shows an exploded view of the connector of FIG. 9.

Referring now to FIG. 10, the second embodiment includes a contact member 171, a bus member 110, wire braids 162 and a pin 166. Base member 110 includes base plates 112, plate section 116 and bracket section 173.

Base member 110 is stamped and formed from a flat metallic strip, preferably from a rigid material such as stainless steel, as base member 110 is not a current carrier. After stamping the metallic strip into a flat metal blank, base plates 112 are formed upwardly from the plates 116, plates 112 and 116 forming perpendicular plate sections having a corner at 118. Feet 114 are also formed downwardly from the plate sections 112, forming a nest area 120.

The two plate portions 116 are interconnected by bracket section 173 which is planar with base sections 116. Bracket section 173 has a portion 174 upstanding from the base sections 116 and has interlocking tabs 176 extending from portion 174. The bracket section 173 also has ears 195 and 199 bent downwardly from the bracket section.

Figure 11A:
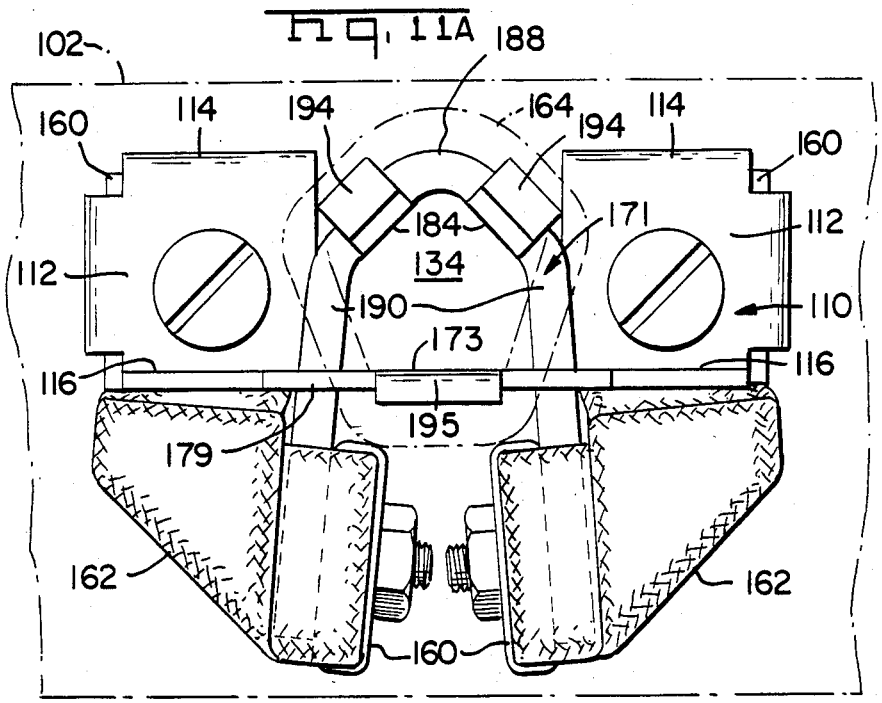
FIG. 11A is a top view of the second embodiment.

Contact section 171 is also stamped and formed from a flat metal strip. The contact 171 is first bent about axis 188 forming the strip into a "V" configuration, as shown in FIG. 11A. The strip is then further bent at axis 190 folding the extension arms 185 inwardly towards themselves, forming flat plate sections 184. Finally, the contact section 171 has ears 194 and 198 bent outwardly from plates 184.

To assemble the connector into the operable configuration as shown in FIG. 9, the contact portion 171 is placed over the base portion 110, the extension arms 185 received between the interlocking tabs 176 and the plate sections 116. When the contact portion 171 is in place, edge 186 rests on plate 116 and tab 176.

To retain the contact portion 171 and base portion 110 resiliently together, springs 164 are wrapped around the two members. As assembled, a first spring 164 surrounds ears 194 on the contact portion 171 and ear 195 on the base portion 110. As such, the spring 164 is held in place between the ears 194 and surfaces 178 of contact assembly 171 and between ears 195 and surfaces 179 on base member 110, as shown in FIG. 9. A second spring 164 surrounds ears 198 on the contact portion 171 and ear 199 on the base portion 110. As such, the spring 164 is held in place between ears 198 and surfaces 180 of contact assembly 171 and between ears 199 and surface 181 (FIG. 10) of the base portion 110, as shown in FIG. 10.

The springs 164 also maintain a preload on the individual contact element 171, inwardly towards the axial centerline of the pin-receiving area. By preloading the contact element 171, less radial movement of the contact element 171 is required to produce the desired contact force between the contact element 171 and the pin 166, which results in increasing the amount of mismatch realignment available between the pin 166 and the contact element 171.

The connector 171 and base 110 may then be mounted on the bus 102. The strap end 160 of strap 162 is placed in the receiving nest 120, aligning holes 163 in the braid end 160 with the holes 122 in the base portion 110, as shown in FIG. 10. The base member 110 and strap 162 are then secured to the bus by conventional means such as bolting to the bus member 102. As attached, the strap end 160 contacts the bus 102 while the base portion 110 is lifted off of the bus member but rather contacts only the strap end 160, as best shown in FIG. 13.

Figure 11B:
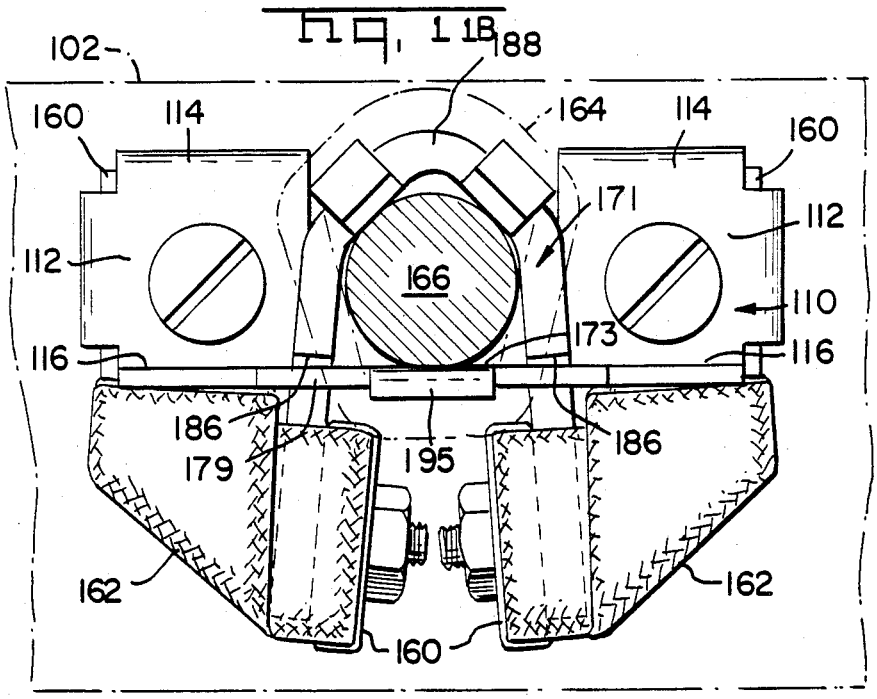
FIG. 11B is similar to that of FIG. 11 showing the pin inserted.

The other strap end 160 may be attached to the extension arms 185 by bolting through holes 165 of strap end 160 and holes 189 of extension arms 185, as shown in FIG. 10. The assembly is then ready for insertion of the pin 166 through the pin entry 134, as shown in FIGS. 11A and 11B.

The pin entry 134 is formed by the plate sections 184 of contact section 171, and by bracket section 173 of base portion 110, as shown in FIG. 11A. When the pin is in place, as shown in FIG. 11B, the contact portion 171 contacts the pin 166 tangentially at two points, with a third point contacting bracket portion 173. That is, the individual contact element 171 has two redundant lines of contact with the pin 166, preventing the effects of constriction resistance.

Figure 12A:
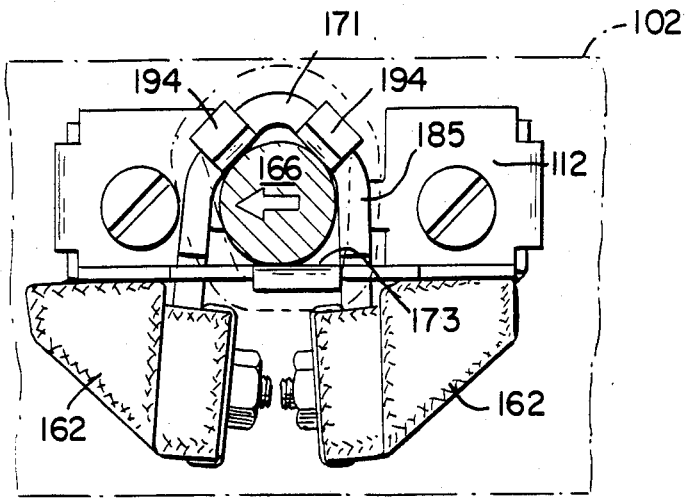
FIG. 12A is similar to FIG. 11B showing the maximum mismatch to the left.
Figure 12B:
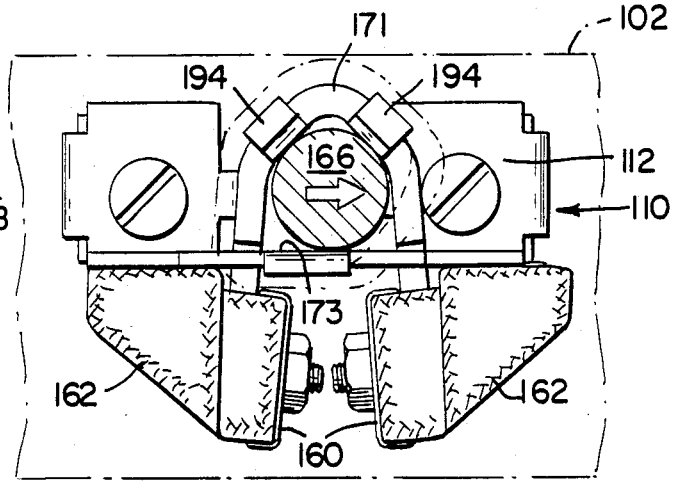
FIG. 12B is similar to FIG. 11B showing the maximum mismatch to the right.
Figure 12C:
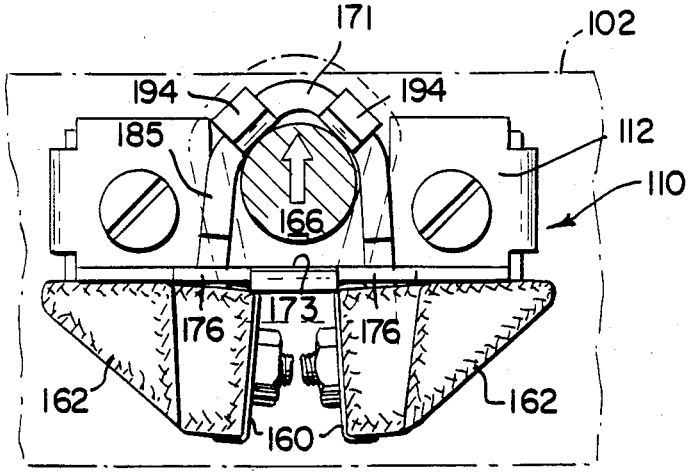
FIG. 12C is similar to FIG. 11B showing the maximum mismatch upwards.

As the contact portion 171 is resiliently connected to the base portion 110 by means of springs 164 and wire straps 162, the contact portion 171 may float with respect to the fixed base portion 110. As shown in FIG. 12A, the contact portion 171 may float to a left justified position until the extension arm 185 on the right contacts the bracket portion 173. As shown in FIG. 12B, the contact portion 171 may float to a right justified position until the extension arm 185 on the left contacts the bracket portion 173. The contact portion 171 may also float away from the base portion 110 until the strap ends 160 contact the tabs 176, as shown in FIG. 12C. Given the ability to float, the pin 166 and pin entry 134 may be misaligned without damage to the bus and module and without having to realign them. By providing positive stops between the contact portion 171 and between base member 110, the spring 164 cannot be overstressed to the point of being elastically deformed.

Figure 15:
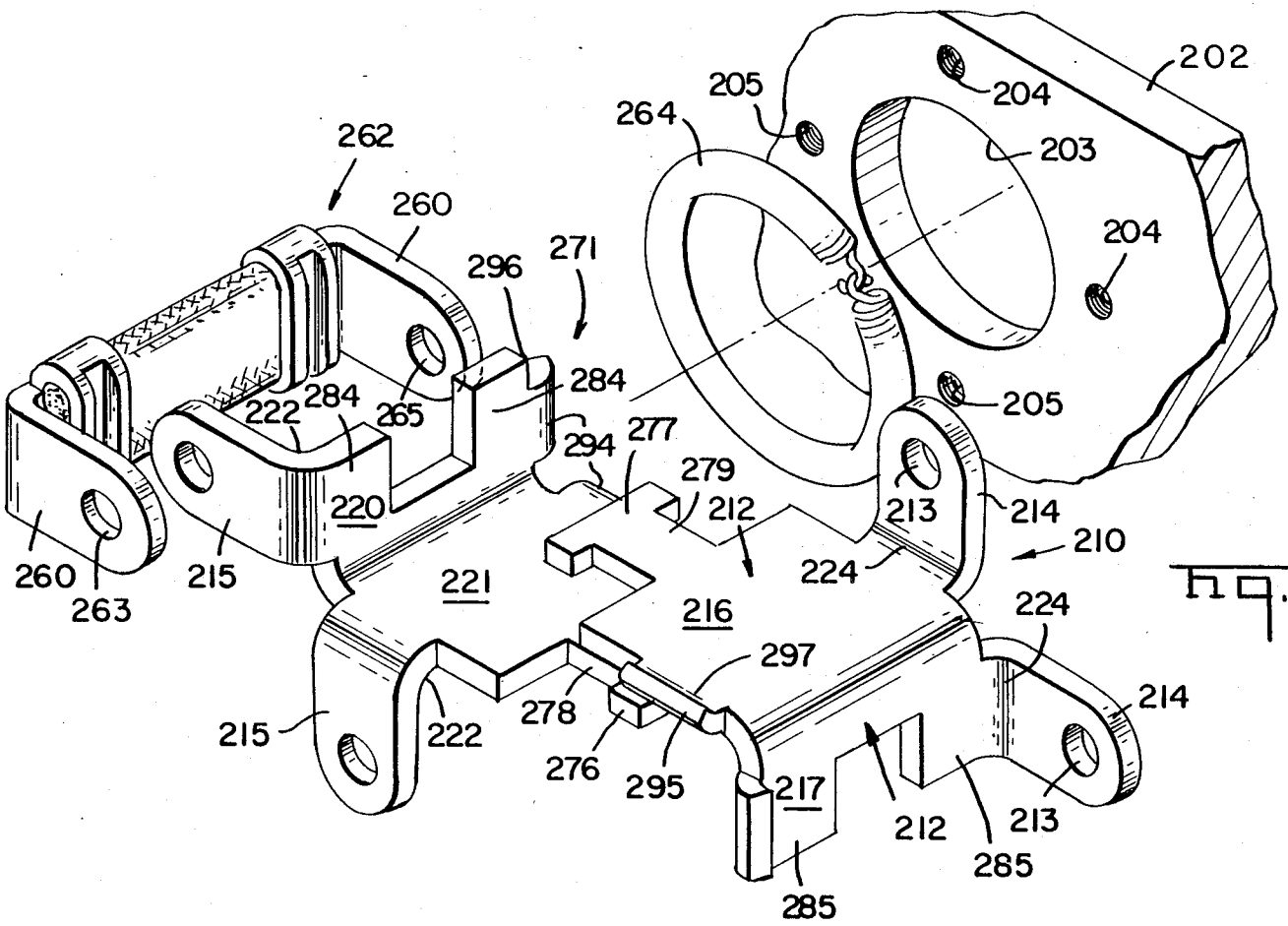
FIG. 15 is an exploded perspective view of the connector portion.
Figure 16:
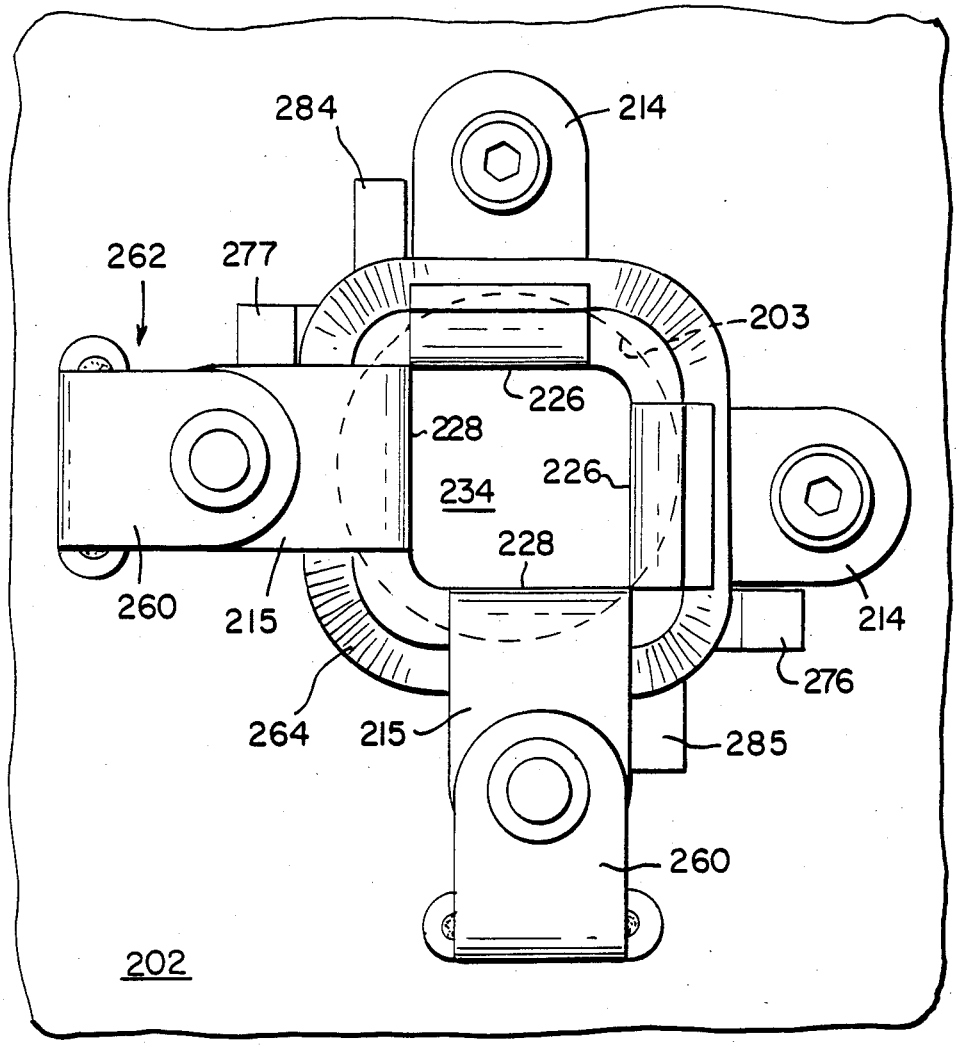
FIG. 16 is a front view of the third embodiment.
Figure 17:
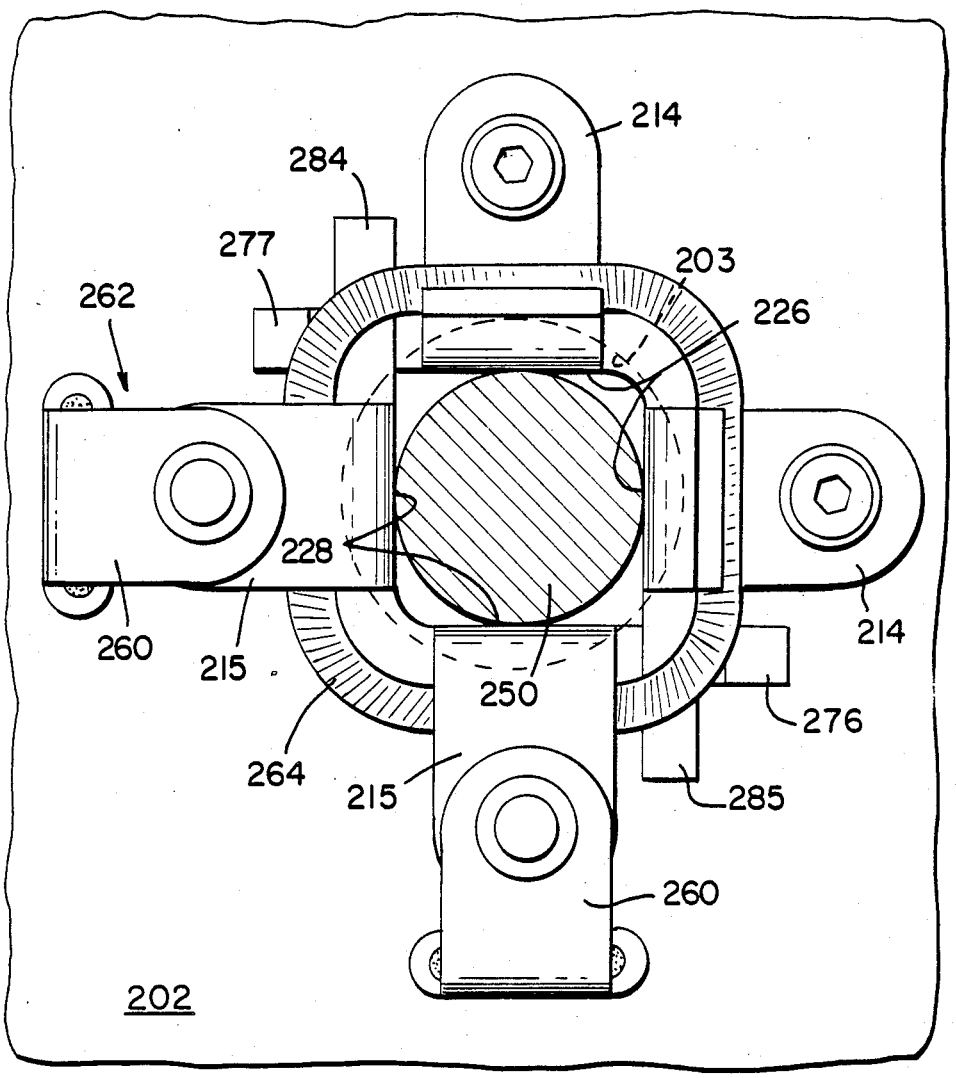

Referring now to FIGS. 14–16, a third embodiment is disclosed, the embodiment comprising a base contact member 210 secured to a bus member 202, a floating contact member 271 and a pin assembly 248. Referring more specifically to FIG. 15, base contact member 210 is formed from a flat plate, stamped and formed to form base plate sections 216 and 217, bent at corner 218 to form two perpendicular plates. Extension arms 285 extend from plate section 216, while tab 277 extends from the opposite plate section 217. Each foot 214 is bent outwardly forming a right angle with each respective plate section 216 and 217. Ears 295 are also bent outwardly from plate sections 216 having an inner radius of curvature 297.

The floating contact member 271 contains base plate sections 220 and 221, feet 215 and ears 294. The contact 271 also has tab 276 extending from the edge of plate section 220 and extension arms 284 extending from respective edges of the plate sections 221. Wire straps 262 contain two strap ends 260 on each end, having bolt holes 265 and 263.

Referring now to FIG. 14A, pin contact assembly 248 comprises flotation block 242, pin 250 and belleville washer 258. Flotation block 242 has pin flotation hole 254 and head flotation counterbore 256. Pin assembly 248 also includes bellville washer 258.

Referring now to FIG. 15, the contact members 271 and 210 are mateably connected by interlocking arms 285 with tab 276 and arms 284 with tab 277, the arms fitting over central portions 278 and 279, respectively. Two springs 264 are then placed over the mated contact members 271 and 210, the first spring 264 placed over feet 214 and ears 294, the spring resting in the radius of curvature 224 and 296. The second spring is placed over feet 215 and over ears 295, the spring resting in radius of curvature 222 and 297.

By connecting interlocking arms 285 with tab 276 and arms 284 with tab 277, the floating contact member 271 is precluded from radial movement to the extent of elastically deforming springs 264, as best shown in FIG. 15. When the contact member 271 floats radially outward from the contact member 210, the tabs 276 and 277 lock within the extension arms 285 and 284, respectively.

As the contact members 271 and 210 are surrounded by springs 264, the contact member 271 is preloaded inwardly towards the pin-receiving area. As the contact member 271 moves a minimal distance radially outward from contact member 210, the pin-to-contact misalignment capability is increased.

Figure 17:
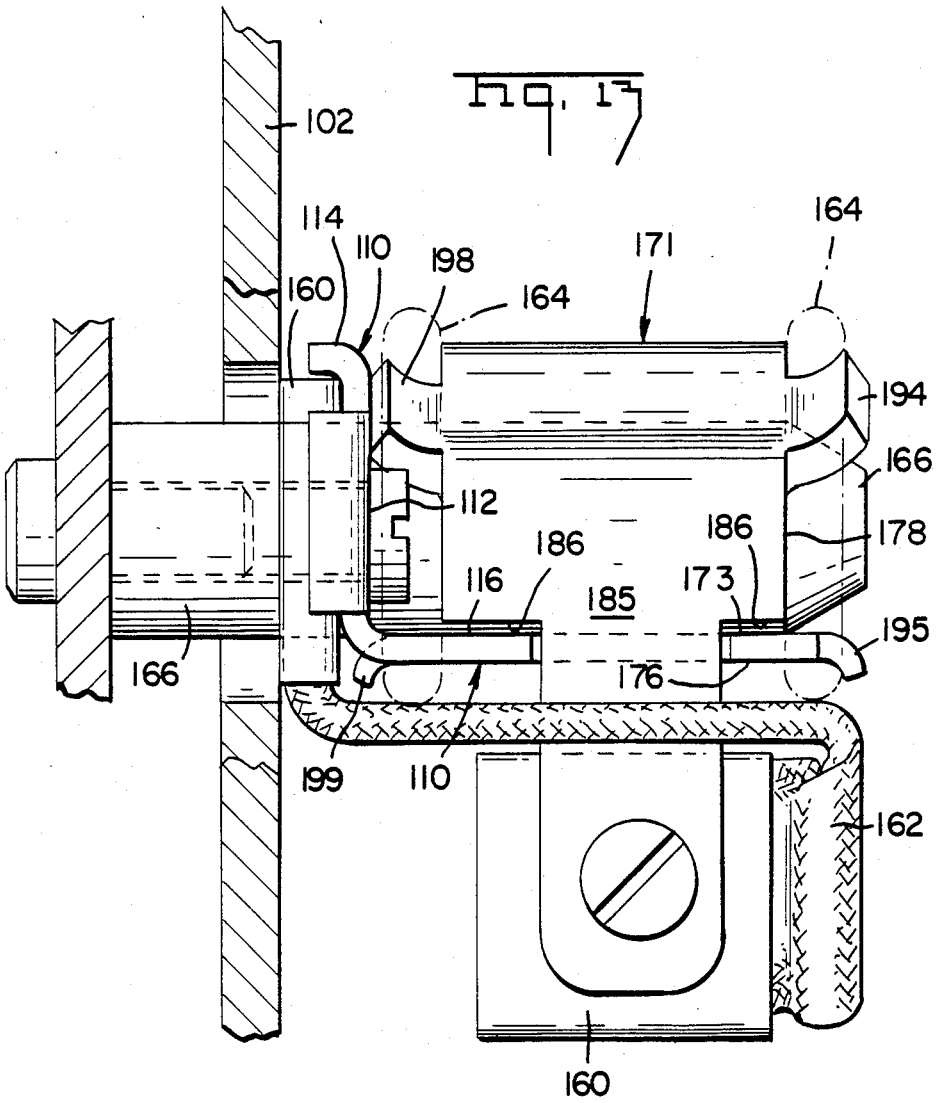
FIG. 17 is similar to FIG. 16A showing the pin inserted.

As assembled, the two contact members 271 and 210 form four contact surfaces; surfaces 226 of plate sections 216 and contact surfaces 228 of plate sections 220, as shown in FIG. 16. When the pin 266 is inserted into the pin-receiving area 234, the pin contacts the surfaces 226 and 228 in four lines of contact, as shown in FIG. 17. Even though the pin may pull the contact 271 away from the contact element 210, the pin 266 will still maintain two parallel lines of contact between surfaces 220 and 221 and the pin 266.

The contact assembly is attached to the bus 202 by first bolting both wire straps 262 to bus 202 through holes 265 in the strap 262 and into tapped holes 205 in the bus. The assembled contact assembly is then bolted to the bus 202, aligning holes 213 in contact member 210 with holes 204 in bus 202. When secured, the pin entry 234 is centered with the pin-receiving hole 203 in bus 202, as best shown in FIG. 16.

The pin assembly 248 is assembled to the module 206 by first placing the belleville washer 258 in the counterbore 256, then placing the pin 250 in and through the pin-receiving hole 254. The assembly is then secured to the module 206 by bolts 244 placed in bolt holes 208 in the module 206. When assembled the belleville washer 258 is partially flattened between surfaces 251 and 253.

When the pin assembly 248 is attached to the module 206 and the contact assembly is connected to the bus member 202, the module may be interconnected to the bus power, even though the pin 250 and pin entry 234 are slightly misaligned. In such a case, the pin 250 may float within block 242 to realign itself. As the diameter of the pin 250 is smaller than the diameter of the pin-receiving hole 254 and as head 252 is smaller in diameter than counterbore 256, the pin 250 may float fully within the block 242. If the pin 250 and pin-receiving hole 234 are slightly misaligned the pin 250 will realign itself within the block 242 as it mates with the pin entry 234 and the resistance of the belleville washer 258, between the pin surface 253 and the block surface 251, will retain the pin in that aligned position.

If the flotation of the pin 250 within the block 242 will not completely take up the misalignment, the contact member 271 may float away from contact member 210 and take up the remaining misalignment. As the contact member 271 is resiliently connected to contact member 210 by means of springs 264, and as contact member 271 is connected to the bus member 202 by means of wire straps 262, the contact member 271 may float away from contact member 210, and retain continuity between the bus member 202 and module 206, via the pin 250 and contact members 271.

The three embodiments disclosed are exemplary of the high current connector concept and should not limit the scope of the following claims.

What is claimed is:

1. An electrical contact assembly for electrical connection with an electrical pin member, comprising:

contact means having contact surface means extending substantially parallel to a first insertion axis and defining a pin-receiving area;

means maintaining said contact means in position so as to form said pin-receiving area, and to allow said contact means to be expandable by the pin member so as to electrically receive the pin member within said pin-receiving area under contact normal force;

means provided by said contact means permitting the pin-receiving area to be movable radially away from said first insertion axis, to a second insertion axis;

means for mounting said contact means onto bus means; and means commoning said contact means to the bus means.

2. The assembly of claim 1 wherein said contact means comprise stamped and formed contact plates.

3. The assembly of claim 1 wherein the maintaining means comprises at least one tension spring in surrounding relationship with the contact means.

4. The assembly of claim 1 wherein the contact means comprises contact plates interlocked with one another to form a cylindrically shaped pin-receiving area.

5. The assembly of claim 4 comprising three contact plates.

6. The assembly of claim 4 wherein the interlocked plates form a cylindrical pin-receiving area having a hexagonal cross section.

7. The assembly of claim 1 wherein the mounting means comprises a base having slots for receiving feet on the individual contact elements.

8. The assembly of claim 7 wherein the feet on the contact elements extend radially outward from the individual contact elements and the slots extend in circular arcs within the base, whereby the individual contact elements may move relative to the base radially away from the first insertion axis to the second insertion axis.

9. The assembly of claim 4 comprising two contact plates.

10. The assembly of claim 9 wherein each plate has two contact surfaces parallel to the axial centerline of said pin-receiving area.

11. The assembly of claim 4, wherein each of the said contact plates has at least two contact surfaces parallel to the axial center line of said pin-receiving area.

12. The assembly of claim 11 wherein the interlocked plates form a cylindrical pin-receiving area having a cross-section substantially square.

13. The assembly of claim 1 wherein the contact means comprises a substantially U-shaped contact member.

14. The assembly of claim 13 wherein the contact member further comprises at least two planar surfaces parallel to the axial centerline of the pin-receiving area.

15. The assembly of claim 1 wherein the contact member is stamped and formed and has a plurality of substantially planar surfaces parallel to said insertion axis.

16. The assembly of claim 15 wherein the mounting means comprises a base.

17. The assembly of claim 16 wherein the base member comprises a flat planar bracket member extending from said base.

18. The assembly of claim 17 wherein the contact member further comprises arms extending from said planar surfaces.

19. The assembly of claim 18 wherein said arms are in overlapping relationship with said bracket member.

20. The assembly of claim 19 wherein the distance between said arms is greater than the width of said bracket member allowing said first contact member to move laterally relative to the insertion axis of said bracket member.

21. An electrical contact assembly for electrical connection with an electrical pin member, comprising:

contact means having contact surface means extending substantially parallel to an insertion axis and defining a pin-receiving area;

biasing means in a circumferentially surrounding relationship with said contact means for biasing and preloading said contact surface means inwardly towards said insertion axis;

means provided by said contact means for maintaining said pin-receiving area, by maintaining said contact surface means in a radially spaced apart relationship with respect to said insertion axis;

means for mounting said contact means; and means for electrically connecting said contact means to an electrical current flow;

whereby, when the electrical pin member is inserted into said pin-receiving area, the contact surface means require minimal radial outward deflection to produce a desired contact force between the contact surface means and the pin member.

22. The assembly of claim 21 wherein the biasing means comprises at least one tension spring surrounding the contact means and forcing the contact elements radially inward.

23. An electrical contact assembly for electrical connection with an electrical pin member, comprising:

contact means having contact surface means defining a pin-receiving area, each said contact surface means having at least two planar surfaces extending lengthwise parallel to an insertion axis, said planar surfaces arranged tangentially to a center of said pin-receiving area;

means maintaining said contact means in position so as to form said pin-receiving area, and to allow said contact means to be moveable so as to electrically receive the pin member within said pin receiving area;

means for mounting said contact means; and means for electrically connecting said contact means to an electrical current flow;

whereby, when the electrical pin member is inserted into said pin-receiving area, said planar surfaces provide two lines of contact with the pin member, the two lines of contact extending axially relative to said pin-receiving area and parallel to each other.

24. An electrical contact assembly for electrical connection with an electrical pin member, comprising:

a base means;

contact means having contact surface means defining a pin-receiving area;

means maintaining said contact means in position so as to form said pin-receiving area, and to bias and preload said contact surfaces inwardly towards said insertion axis;

means provided by said contact means and said base means affixing said contact means in a fixed axial relationship, while allowing said contact means to move relative to said base means in a radial direction relative to said insertion axis; and means for electrically connecting said contact means to an electrical current flow; whereby, when an electrical pin member, to be inserted in said pin-receiving area, is radially misaligned with said pin-receiving area, the contact means realigns itself to the electrical pin member without affecting the insertion force of the pin.

* * * * *